US010041350B2

(12) United States Patent
Mohn et al.

(10) Patent No.: US 10,041,350 B2
(45) Date of Patent: Aug. 7, 2018

(54) HYDROSTATIC POSITIVE DISPLACEMENT MACHINE

(71) Applicant: Robert Bosch GmbH, Stuttgart (DE)

(72) Inventors: Ulrich Gordon Mohn, Horb (DE); Heiko Erlenkeuser, Anderson, SC (US); Martin Buck, Pfrontstetten (DE); Rene Scheerer, Freudenstadt (DE)

(73) Assignee: Robert Bosch GmbH, Stuttgart (DE)

( * ) Notice: Subject to any disclaimer, the term of this patent is extended or adjusted under 35 U.S.C. 154(b) by 270 days.

(21) Appl. No.: 14/921,492

(22) Filed: Oct. 23, 2015

(65) Prior Publication Data

US 2016/0115792 A1 Apr. 28, 2016

(30) Foreign Application Priority Data

Oct. 27, 2014 (DE) ..... 10 2014 221 791

(51) Int. Cl.

| | |
|---|---|
| ***F01C 20/18*** | (2006.01) |
| ***F03C 4/00*** | (2006.01) |
| ***F04C 14/18*** | (2006.01) |
| ***F04C 28/18*** | (2006.01) |
| ***F01C 1/30*** | (2006.01) |
| ***F04C 18/30*** | (2006.01) |
| ***F01C 20/22*** | (2006.01) |
| ***F01C 1/344*** | (2006.01) |

(52) U.S. Cl.
CPC ..... *F01C 20/22* (2013.01); *F01C 1/3441* (2013.01)

(58) Field of Classification Search
CPC ..... F01C 20/22; F01C 1/3441
USPC ..... 418/31, 260, 24–26, 27, 29
See application file for complete search history.

(56) References Cited

U.S. PATENT DOCUMENTS

| | | | | |
|---|---|---|---|---|
| 3,687,579 A * | 8/1972 | Martin | F04C 14/223 | 418/26 |
| 4,259,039 A * | 3/1981 | Arnold | F04C 14/223 | 417/220 |
| 5,183,392 A * | 2/1993 | Hansen | F02M 37/18 | 417/203 |
| 5,752,815 A * | 5/1998 | Muller | F16N 13/20 | 418/26 |

FOREIGN PATENT DOCUMENTS

DE 10 2010 054 416 A1 6/2012

* cited by examiner

*Primary Examiner* — Deming Wan
(74) *Attorney, Agent, or Firm* — Maginot, Moore & Beck LLP

(57) ABSTRACT

A hydrostatic positive displacement machine has a cam ring for adjusting the displacement volume thereof. This cam ring is guided in translation by approximately diametrically arranged outer circumferential surface segments on associated inner surface segments of a housing of the positive displacement machine.

17 Claims, 4 Drawing Sheets

HYDROSTATIC POSITIVE DISPLACEMENT MACHINE

This application claims priority under 35 U.S.C. § 119 to patent application number DE 10 2014 221 791.1, filed on Oct. 27, 2014 in Germany, the disclosure of which is incorporated herein by reference in its entirety.

BACKGROUND

The disclosure relates to a hydrostatic positive displacement machine.

DE 10 2010 054 416 A1 shows a positive displacement machine of the type in question which is configured as a vane pump. This has a housing, on which a rotor fitted with radially movable vanes is mounted so as to be rotatable about an axis of rotation. The vanes are supported on an inner circumferential surface of a cam ring mounted eccentrically with respect to the rotor. An annular space is formed between the rotor and the cam ring, said annular space being subdivided by the vanes into hydrostatic working spaces which can be brought alternately into pressure medium connection with a high-pressure and a low-pressure connection of the positive displacement machine.

On the circumference, the cam ring has two diametrically arranged outer circumferential surface segments, by means of which it is guided in translation transversely to the axis of rotation on inner surface segments of the housing in order to adjust a displacement volume of the vane pump.

When some of the working spaces are connected to high pressure, the inner circumferential surface of the cam ring is subjected to pressure medium, resulting in the deformation thereof. Accordingly, the outer circumferential surface segments are also deformed, leading to non-uniform distribution of the surface pressure between the outer circumferential surface segments and the inner surface segments. This results in increasing wear of the participating surface segments as the working pressure increases.

Various concepts for reducing wear are known from the prior art. A first is shown by the German Laid-Open Application mentioned. In this case, one or more groove profiles subjected to pressure medium are formed in one or more of the surface segments, thereby making it possible to produce a hydrostatic relief field by means of which friction between the surface segments is reduced.

This secondary measure for reducing wear by reducing friction proves disadvantageous since production of the grooves is expensive.

In an alternative concept to this, the cam ring is mounted in rolling or revolving contact by means of its outer circumferential surface segments on the inner surface segments of the housing.

The disadvantage of this is the high complexity of the apparatus, which makes the positive displacement machine expensive.

SUMMARY

In contrast, it is the underlying object of the disclosure to provide a hydrostatic positive displacement machine with reduced wear, which is nevertheless simplified in terms of apparatus.

This object is achieved by a hydrostatic positive displacement machine having the features described below.

Advantageous developments of the positive displacement machine are described in the following description.

A hydrostatic positive displacement machine has a housing, in which a rotor is mounted so as to be rotatable about an axis of rotation, said rotor being fitted with substantially radially movable space dividers, in particular with vanes or rollers. Here, the space dividers are supported on an inner circumferential surface of a cam ring, in particular a cam ring which can be arranged eccentrically with respect to the rotor. An annular space is formed between the rotor and the cam ring, said annular space being subdivided by the space dividers into hydrostatic working spaces which revolve with the rotor and can be brought alternately into pressure medium connection with a high pressure and a low pressure. When some of the working spaces are in pressure medium connection with the high pressure, deformation of the cam ring results from the pressure force acting on the cam ring. In particular, the cam ring has two approximately diametrically arranged outer circumferential surface segments, by means of which it is guided in translation transversely to the axis of rotation on associated inner surface segments of the housing in order to adjust a displacement volume of the positive displacement machine. According to the disclosure, at least one of the outer circumferential surface segments—preferably both—has a topology which deviates from that of a plane in a load-free mode of the positive displacement machine. In the sense according to this publication, "load-free mode" designates an operating state in which the hydrostatic working spaces are separated from the high pressure. In contrast, "loaded mode" designates a state of the positive displacement machine in which some of the working spaces are fluidically connected to the high pressure and, consequently, the cam ring is subjected to the pressure force and deformed.

In the loaded mode, the deformation of the cam ring gives the outer circumferential surface segment having the topology according to the disclosure a shape which leads to less wear in comparison with the prior art. As a result, the known, low-cost concept of sliding cam ring support can also be used for higher pressures and there is no need to resort to rolling, rotatory or revolving support, which is complex in terms of apparatus.

In a preferred development, the topology in the load-free mode is chosen so that it approaches a plane in the loaded mode of the positive displacement machine.

In a preferred development, the topology deviates from that of a plane in such a way that, in the loaded mode, a contact area of the outer circumferential surface segment with the inner surface segment is approximately equal to the outer circumferential surface segment. Force transmission from the cam ring to the housing thus takes place via approximately the entire outer circumferential surface segment and not merely via partial areas thereof, thereby giving a lower surface pressure and hence lower wear.

In a preferred development, the topology deviates from that of the plane in such a way that, in the loaded mode, a surface pressure between the outer circumferential surface segment and the inner surface segment is distributed in a substantially spatially uniform manner. Stress peaks are thus virtually absent or at least reduced as compared with the prior art, thereby likewise reducing wear.

In a preferred development, the topology is produced by erosion or 3-D milling. Particularly by means of production methods of this kind, the topology can be configured as a relief matched to a specific operating point, with the result that the surface pressure is distributed in a spatially particularly uniform manner at this operating point.

Here, the topology or relief is preferably determined by means of a topography-optimizing method, e.g. a recursive finite element method. Methods of this kind can be determined using a finite element design program, such as TOSCA Structure, for example.

In a preferred development, the positive displacement machine has a low-pressure duct fixed in relation to the housing and a high-pressure duct fixed in relation to the housing, which both open into the annular space or are at least in pressure medium connection therewith. In this case, the at least one outer circumferential surface segment of optimized topology is preferably arranged closer to the mouth of the high-pressure duct than to the mouth of the low-pressure duct.

In the loaded mode, the outer circumferential surface segment of a conventional cam ring shows a primary deformation with hollow or concave cross sections oriented transversely to the axis of rotation. In order to counteract this type of primary deformation, the topology of the at least one outer circumferential surface segment in a preferred development is selected so as to have cambered or convex cross sections in the unloaded mode. This development represents a simple solution in terms of apparatus and in terms of production. Here, the camber can be accomplished by producing a cylindrical outer circumferential surface segment with a fixed radius, e.g. by means of external circular grinding. A cylinder longitudinal axis is preferably axially parallel to the axis of rotation of the positive displacement machine.

In the loaded mode, the at least one outer circumferential surface segment can exhibit a secondary deformation with convex longitudinal sections oriented longitudinally with respect to the axis of rotation. In the edge regions of these longitudinal sections, the secondary deformation then results in reduced contact stresses of the outer circumferential surface segment with the inner surface segment. In order to improve the extent to which the contact stress is made uniform across the entire outer circumferential surface segment, the topology of the unloaded outer circumferential surface segment is preferably developed in such a way that the outer circumferential surface segment has an additional projection in the direction of the inner surface segment in said edge regions. The longitudinal sections of the outer circumferential surface segment in the unloaded mode are preferably of hollow or concave design. Said projection can be produced, for example, by increasing the radius of the cylindrical outer circumferential surface segment with or without a simultaneous displacement of the central axis. This can be accomplished by profile grinding, for example. In this way, it is possible to compensate the deformation effects through the secondary deformation in the edge regions.

In a preferred development, the surface pressure is reduced by the fact that a length of the outer circumferential surface segment, measured in a translatory direction, is approximately equal to or greater than the length of a projection of the inner circumferential surface transversely to the axis of rotation onto a plane defined by the translatory direction.

In a preferred development, the positive displacement machine has a hydrostatic relief field between the outer circumferential surface segment and the inner surface segment to further reduce wear.

The hydrostatic positive displacement machine can be configured and operable as a hydraulic motor and/or a hydraulic pump. It is preferably configured as a roller-cell or vane pump.

BRIEF DESCRIPTION OF THE DRAWINGS

A number of illustrative embodiments of a hydrostatic positive displacement machine according to the disclosure are shown in the drawings. The disclosure will now be explained in greater detail by means of the figures of said drawings, wherein.

DETAILED DESCRIPTION

It may be assumed that components or structural parts which remain the same throughout the figures and illustrative embodiments are provided with the same reference signs.

Figure 1:
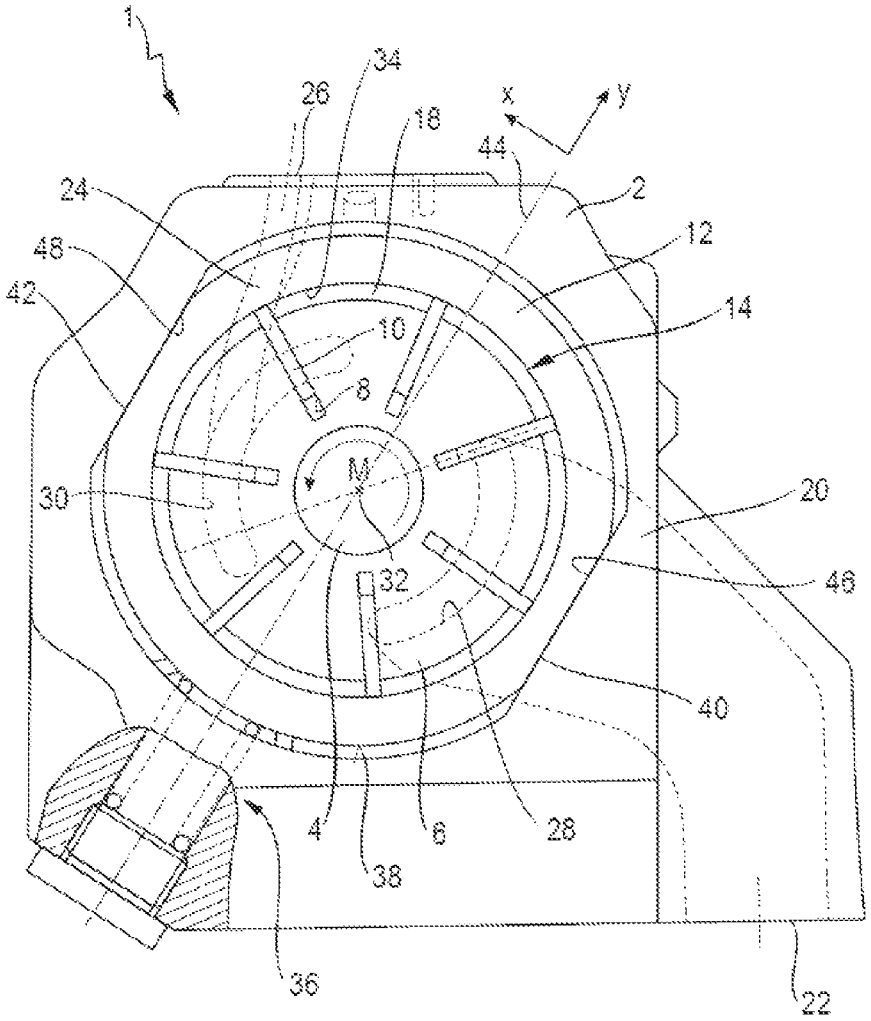
FIG. 1 shows a first illustrative embodiment in a cross section.

According to FIG. 1, a positive displacement machine 1 is configured as a vane pump. The vane pump 1 has a housing 2, in which a drive shaft 4 is accommodated in a rotatably mounted manner. Connected for conjoint rotation to the drive shaft 4 is a rotor 6, which has circumferentially uniformly distributed radial recesses 8, each of which is fitted with a space divider 10 configured as a vane. In this arrangement, the vanes 10 are accommodated in a sliding manner in the radial recesses 8 and preloaded radially outwards.

The rotor 6 is surrounded radially by a cam ring 12 having a substantially circular-cylindrical inner circumferential surface, with the result that an annular space 14 is formed between said cam ring and the rotor 6. The vanes 10 are supported radially on the outside on an inner circumferential surface 34 of the cam ring 12. In this way, the annular space 14 is subdivided into hydrostatic working spaces 18 by the vanes 10. In pressure medium connection with the annular space 14 there is a low-pressure duct 20 of a low-pressure connection 22 of the positive displacement machine 1 and a high-pressure duct 24 of a high-pressure connection 26 of the positive displacement machine 1. Here, mouths 28, 30 of the pressure medium ducts 20, 24 extend approximately in a kidney shape on both sides of an axis of rotation 32 of the drive shaft 4.

The cam ring 12 is mounted for translation transversely to the axis of rotation 32 in the housing 2. In this way, the displacement volume of the positive displacement machine 1 can be adjusted since the eccentricity of the inner circumferential surface 34, on the which the vanes 10 are supported, with respect to the axis of rotation 32 can be varied by moving the cam ring 12.

Radially on the outside, the cam ring 12 has a predominantly circular-cylindrical outer circumferential surface 38, which has two diametrically arranged, flattened outer circumferential surface segments 40 and 42. Both outer circumferential surface segments 40, 42 extend substantially parallel to sliding axis 44 of the cam ring 12. By means of the outer circumferential surface segments 40, 42, the cam ring 12 is guided in a sliding manner on corresponding inner surface segments 46, 48 of the housing 2.

Figure 2:
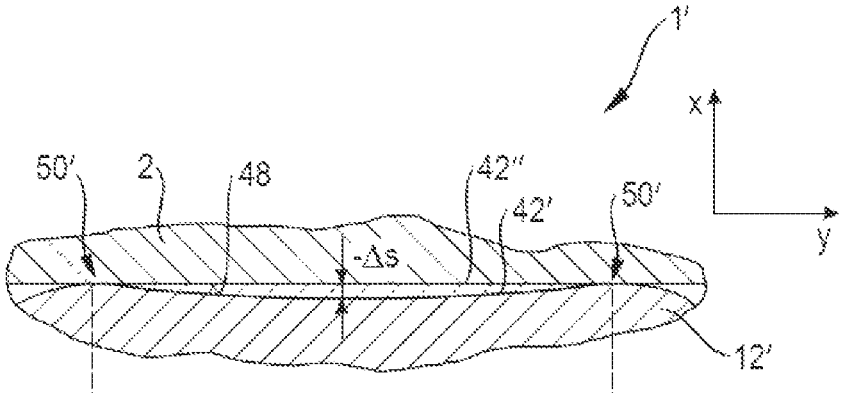
FIG. 2 shows a topology of a cam ring of a conventional positive displacement machine in an unloaded mode and the deformation thereof in the loaded mode, in a cross section.

To illustrate the problems solved by the positive displacement machine 1 according to the disclosure, FIG. 2 shows a partial section through a conventional positive displacement machine 1' having a conventional cam ring 12'. FIG. 2 shows the housing 2 and the conventional cam ring 12' in the region of its outer circumferential surface segment 42' and the inner surface segment 48 in the loaded operating state, in which the high-pressure kidney-shaped port 30 is supplied with high pressure present at the high-pressure connection 26. Accordingly, the high pressure is present in those working spaces which are in pressure medium connection with the high-pressure kidney-shaped port and acts on the inner circumferential surface of the cam ring 12'.

It should be noted that, to illustrate the disclosure, the following topologies or deformations which deviate from a plane are shown on an exaggerated scale.

Starting from its topology 42" which is planar or flat in the unloaded mode, the outer circumferential surface segment 42' shown in FIG. 2 is deformed radially inwards with a maximum deformation $-\Delta s$ when the inner circumferential surface is subjected to pressure, whereby the cam ring 12' is then in contact with the inner surface segment 48 only with its end regions 50'—as viewed in the direction of the sliding axis. For force transmission from the conventional cam ring 12' to the housing 2, there is thus only a relatively small proportion of the planar topology 42" still available. For this reason, a surface pressure between the resulting outer circumferential surface segment 42' and the inner surface segment 48 is increased, leading to increased wear.

Figure 3:
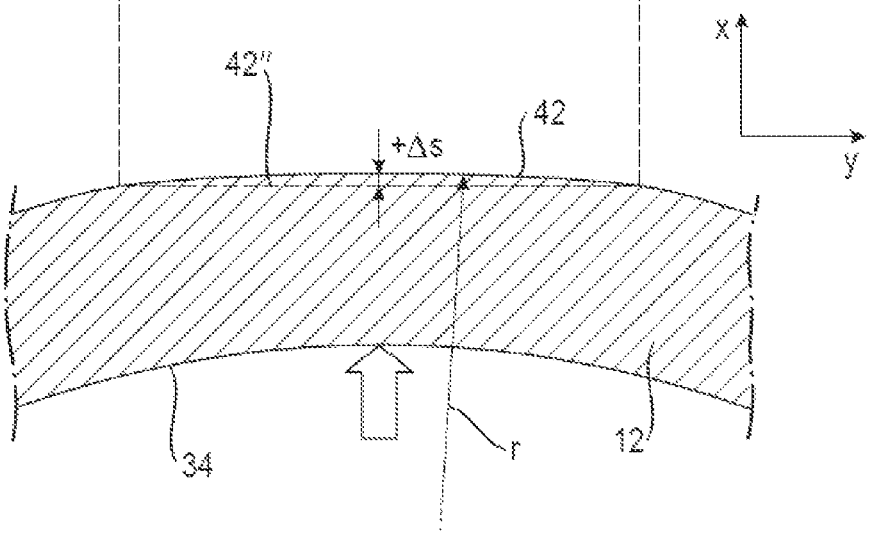
FIG. 3 shows a topology of a first illustrative embodiment of a cam ring of the positive displacement machine from FIG. 1 in the unloaded mode, in a cross section.

FIG. 3 shows the cam ring 12 according to the disclosure of the positive displacement machine 1 from FIG. 1 in a cross section transversely to the axis of rotation 32. The topology of the outer circumferential surface segment 42 according to the disclosure is made cambered, oppositely to the above-described deformation $-\Delta s$, at $+\Delta s$. Here, the outer circumferential surface segment 42 has been provided with a radius r by means of external circular grinding. If the inner circumferential surface 34 is then subjected to the force symbolized by the arrow, there is in principle an approximately concave deformation of the kind already known from the conventional outer circumferential surface segment 42' shown in FIG. 2. Owing to the cambered or convex embodiment of the outer circumferential surface segment 42, however, a substantially planar shape of the outer circumferential surface segment 42 is obtained according to the disclosure in the case of load, corresponding approximately to the planar topology 42" shown in FIG. 3.

Figure 4:
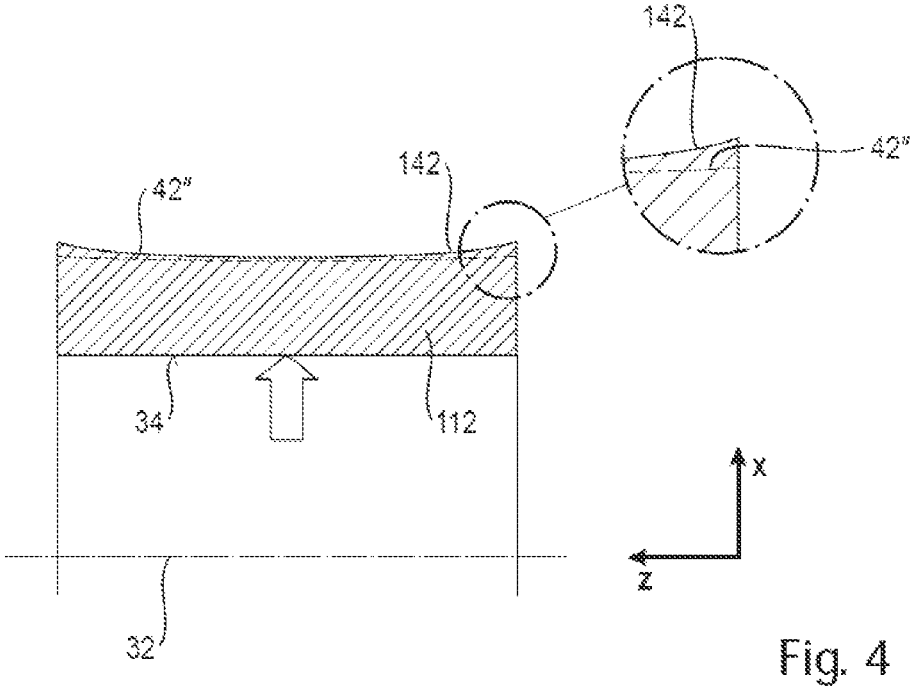
FIG. 4 shows a topology of a second illustrative embodiment of a cam ring in the unloaded mode, in a longitudinal section.

FIG. 4 shows a longitudinal section, taken along the axis of rotation 32, of a second illustrative embodiment of a cam ring 112 according to the disclosure. The sliding direction (y) of the cam ring 112 is consequently aligned perpendicularly to the plane of view. Like the cam ring 12 shown in FIG. 3, the cam ring 112 shown in FIG. 4 shows the cross-sectional camber discussed. Since the force illustrated as an arrow in FIG. 4 and acting on the inner circumferential surface 34 would lead, starting from an imagined planar outer circumferential surface segment, to convex longitudinal sections and, as a consequence, to a reduced contact stress between the outer circumferential surface segment 142 and the inner surface segment 48, projections of cam ring 112 are arranged in the edge regions in this development. When subjected to load, outer circumferential surface segment 142 then deforms again in the direction of the planar topology 42".

Figure 5:
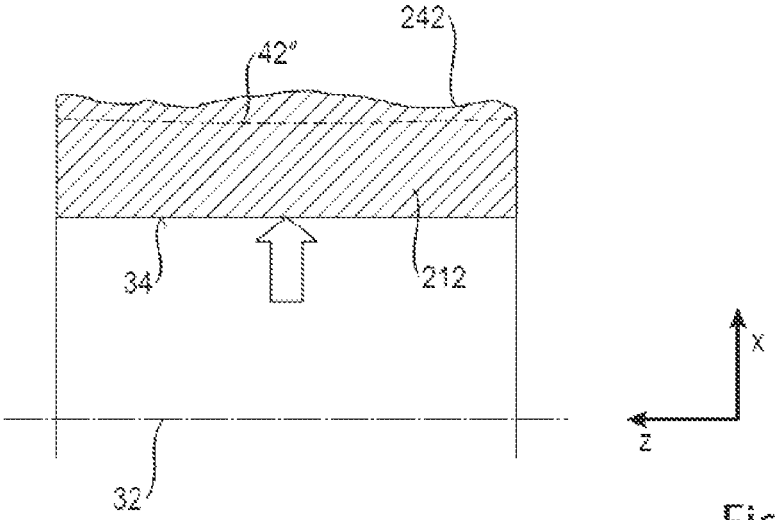
FIG. 5 shows a topology of a third illustrative embodiment of a cam ring in the unloaded mode, in a longitudinal section.

FIG. 5 shows a third illustrative embodiment of an outer circumferential surface segment 242 according to the disclosure of optimized topology, the cross sections of which, as already described, are of cambered design, and the longitudinal sections of which, as shown in FIG. 5 (along the axis of rotation 32) have a relief configured to a specific operating point of the positive displacement machine. Reliefs of this kind can be produced by means of 3-D milling or profile grinding, for example.

Figure 6:
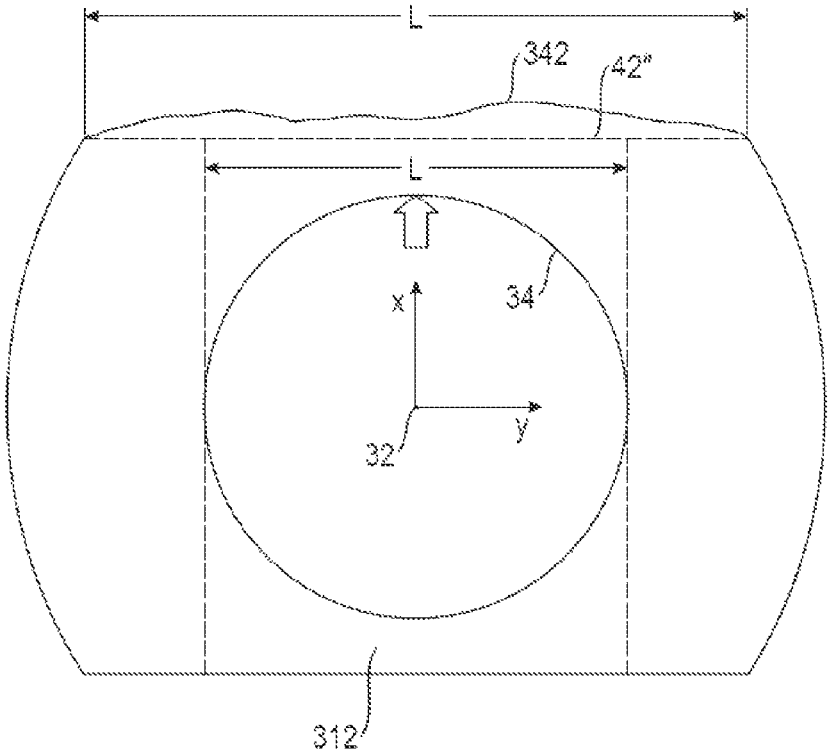
FIG. 6 shows a topology of a fourth illustrative embodiment of a cam ring in the unloaded mode, in a cross section.

FIG. 6 shows a fourth illustrative embodiment of a cam ring 312 having an outer circumferential surface segment 342 according to the disclosure of optimized topology. Outer circumferential surface segment 342 is also ground with the aid of the abovementioned 3-D milling or profile grinding to a topology optimized for one operating point. Moreover, a length L of outer circumferential surface segment 342, measured in a translatory direction (y), is greater than a length l of a projection of the inner circumferential surface 34 onto a plane defined by the translatory direction (y), transversely to the axis of rotation 32. In this way, the force acting on the inner circumferential surface 34, which is symbolized as an arrow, can be transferred via the relatively large outer circumferential surface segment 342 to the inner surface segment 48, thereby further reducing the contact stress.

A disclosure is made of a hydrostatic positive displacement machine, which is preferably configured on the vane or roller-cell principle. Here, a rotor fitted with vanes or rollers is mounted so as to be rotatable about an axis of rotation in a housing of the positive displacement machine. The vanes or rollers acting as space dividers are supported on an inner circumferential surface of a cam ring, wherein an annular space is formed between the rotor and the cam ring, said annular space being subdivided by the space dividers into hydrostatic working spaces. For translatory guidance of the cam ring transversely to the axis of rotation, said ring has outer circumferential surface segments, via which it is supported movably on associated inner surface segments of the housing. According to the disclosure, at least one of the outer circumferential surface segments has a topology which deviates from that of a plane in a load-free mode of the positive displacement machine.

LIST OF REFERENCE SIGNS

1 hydrostatic positive displacement machine
1' conventional hydrostatic positive displacement machine
2 housing
4 drive shaft
6 rotor
8 radial recess
10 space divider
11 cam ring
12' conventional cam ring
14 annular space
18 working space
20 low-pressure duct
22 low-pressure connection
24 high-pressure duct
26 high-pressure connection
28 low-pressure kidney-shaped port
30 high-pressure kidney-shaped port
32 axis of rotation
34 inner circumferential surface
36 adjusting device
38 outer circumferential surface
40, 42 outer circumferential surface segment
42' conventional, loaded outer circumferential surface segment 42" planar topology of outer circumferential surface segment
44 sliding axis
46, 48 inner surface segment
r radius of camber
l length of projection
L length of outer circumferential segment

What is claimed is:

1. A hydrostatic positive displacement machine, comprising:

a housing;

a rotor mounted in the housing so as to be rotatable about an axis of rotation, said rotor being fitted with radially movable space dividers; and a cam ring having an inner circumferential surface on which the space dividers are supported, wherein an annular space is formed between the rotor and the cam ring, said annular space being subdivided by the space dividers into hydrostatic working spaces configured to revolve with the rotor and be brought alternately into pressure medium connection with a high pressure and a low pressure, wherein the cam ring has approximately diametrically arranged outer circumferential surface segments configured to guide the cam ring in a straight line translation transversely to the axis of rotation on associated inner surface segments of the housing, wherein at least one of the outer circumferential surface segments has a first surface portion directly opposite a second surface portion of an associated inner surface segment which does not mirror the second surface portion in a load-free mode of the positive displacement machine, wherein the first surface portion is non-planar and the second surface portion is planar.

2. The positive displacement machine according to claim 1, wherein a contact area of the second l surface portion with the first surface portion is approximately equal to the second surface portion in a loaded mode.

3. The positive displacement machine according to claim 1, wherein a surface pressure between the at least one of the outer circumferential surface segments and the inner surface segment is distributed in a spatially uniform manner in a loaded mode.

4. The positive displacement machine according to claim 1, wherein the first surface portion is produced by one of erosion and 3-D milling such that a surface pressure is distributed in a spatially uniform manner.

5. The positive displacement machine according to claim 1, further comprising:

a low-pressure duct fixed in relation to the housing; and a high-pressure duct fixed in relation to the housing, wherein the low-pressure duct and the high-pressure duct open into said annular space, and wherein the at least one of the outer circumferential surface segment is arranged adjacent to a mouth of the high-pressure duct and remote from a mouth of the low-pressure duct.

6. The positive displacement machine according to claim 1, wherein cross sections of the at least one of the outer circumferential surface segment are one of cambered and convex transversely to the axis of rotation in a load-free mode.

7. The positive displacement machine according to claim 1, wherein longitudinal sections of the at least one of the outer circumferential surface segment are hollow or concave along the axis of rotation in a load-free mode.

8. The positive displacement machine according to claim 1, wherein a length of the at least one of the outer circumferential surface segment in a translatory direction is approximately equal to or greater than a length of a projection of the inner circumferential surface in a plane defined by the translatory direction.

9. The positive displacement machine according to claim 1, wherein a hydrostatic relief field is provided between the at least one of the outer circumferential surface segment and the inner surface segment.

10. The positive displacement machine according to claim 1, wherein a length of the at least one of the outer circumferential surface segment in a translatory direction is approximately equal to or greater than a length of a projection of the inner circumferential surface in a plane defined by the translatory direction.

11. A hydrostatic positive displacement machine, comprising:

a housing;

a rotor mounted in the housing so as to be rotatable about an axis of rotation, said rotor fitted with radially movable space dividers; and a cam ring having an inner circumferential surface on which the space dividers are supported, wherein an annular space is formed between the rotor and the cam ring, said annular space subdivided by the space dividers into hydrostatic working spaces configured to revolve with the rotor and be brought alternately into pressure medium connection with a high pressure and a low pressure, wherein the cam ring has approximately diametrically arranged outer circumferential surface segments configured to guide the cam ring in translation transversely to the axis of rotation on associated inner surface segments of the housing, wherein at least one of the outer circumferential surface segments has a non-planar surface directly opposite the associated inner surface segment in a load-free mode of the positive displacement machine, wherein longitudinal sections of the at least one of the outer circumferential surface segment are hollow or concave along the axis of rotation in a load-free mode, wherein the at least one of the outer circumferential surface segments has a first surface portion directly opposite a second surface portion of the associated inner surface segment which does not mirror the second surface portion of the associated inner surface segment in a load-free mode of the positive displacement machine, and wherein a contact area of the second surface portion with the first surface portion is approximately equal to the second surface portion in a loaded mode.

12. The hydrostatic positive displacement machine of claim 11, wherein the outer circumferential surface segments are configured to guide the cam ring in a straight line translation transversely to the axis of rotation on associated inner surface segments of the housing.

13. The positive displacement machine according to claim 11, wherein a surface pressure between the at least one of the outer circumferential surface segments and the inner surface segment is distributed in a spatially uniform manner in a loaded mode.

14. The positive displacement machine according to claim 11, wherein the at least one of the outer circumferential surface segments is produced by one of erosion and 3-D milling such that a surface pressure is distributed in a spatially uniform manner.

15. The positive displacement machine according to claim 11, further comprising:

a low-pressure duct fixed in relation to the housing; and a high-pressure duct fixed in relation to the housing, wherein the low-pressure duct and the high-pressure duct open into the annular space, and wherein the at least one of the outer circumferential surface segment is arranged adjacent to a mouth of the high-pressure duct and remote from a mouth of the low-pressure duct.

16. The positive displacement machine according to claim 11, wherein cross sections of the at least one of the outer circumferential surface segment are one of cambered and convex transversely to the axis of rotation in a load-free mode.

17. The positive displacement machine according to claim 11, wherein a hydrostatic relief field is provided between the at least one of the outer circumferential surface segment and the inner surface segment.

* * * * *